US007293598B2

(12) United States Patent
Bend

(10) Patent No.: US 7,293,598 B2
(45) Date of Patent: Nov. 13, 2007

(54) CYLINDER LINER IMPROVEMENTS

(75) Inventor: Robert J. Bend, Plymouth, MI (US)

(73) Assignee: Equipment Merchants International Inc., Cleveland, OH (US)

( * ) Notice: Subject to any disclaimer, the term of this patent is extended or adjusted under 35 U.S.C. 154(b) by 0 days.

(21) Appl. No.: 10/564,926

(22) PCT Filed: Jul. 15, 2004

(86) PCT No.: PCT/AU2004/000949

§ 371 (c)(1),
(2), (4) Date: Jan. 17, 2006

(87) PCT Pub. No.: WO2005/007324

PCT Pub. Date: Jan. 27, 2005

(65) Prior Publication Data

US 2006/0157216 A1 Jul. 20, 2006

(30) Foreign Application Priority Data

Jul. 16, 2003 (AU) ..... 2003903648

(51) Int. Cl.
*B22D 33/04* (2006.01)

(52) U.S. Cl. ..... 164/137; 164/369; 164/37

(58) Field of Classification Search ..... 164/137, 164/98, 369, 37

See application file for complete search history.

(56) References Cited

U.S. PATENT DOCUMENTS 5,361,823 A 11/1994 Kuhn et al. ..... 164/9
5,365,997 A 11/1994 Helgesen et al. ..... 164/103
5,771,955 A 6/1998 Helgesen et al. ..... 164/9
5,983,975 A * 11/1999 Nilsson ..... 164/98
6,615,901 B2 * 9/2003 Kaminski et al. ..... 164/137
2002/0185251 A1 12/2002 Kaminski et al. ..... 164/137

OTHER PUBLICATIONS

PCT/AU2004/000949; International Search Report mailed Aug. 26, 2004.

* cited by examiner

*Primary Examiner*—Len Tran
(74) *Attorney, Agent, or Firm*—Renner, Otto, Boisselle & Sklar

(57) ABSTRACT

An engine block mold, including at least one barrel slab core (10), the or each barrel slab core (10) including a slab portion (12), and at least one barrel portion (14) adapted to receive a cylinder liner (1), wherein the barrel portion (14) of the or each barrel slab core (10) has an outer diametral taper along at least a portion of its length, and the or each liner (1) has a substantially matching internal diametral taper along at least a portion of its length. Inserting the or each slab barrel core (10) with the or each liner (1) disposed upon it, into a substantially completed mold casing, filling the mold, and then machining the cylinder liners (1) so that they have a substantially constant internal diameter along their length.

13 Claims, 2 Drawing Sheets

CYLINDER LINER IMPROVEMENTS

TECHNICAL FIELD

The present invention relates to cylinder liners and mold assembly techniques for alloy engine blocks.

BACKGROUND ART

The present invention relates to cylinder liners and mold assembly techniques for alloy engine blocks.

It is common practice in the automotive and engine-manufacturing industry to keep the weight of the component parts of a vehicle to a minimum if possible, as this has benefits associated with both the handling and fuel consumption of the completed vehicle. Thus while engine blocks were for long periods cast from cast iron, the cylinder bores were carefully machined to receive the pistons of the engine. However with the introduction of aluminium cylinder blocks, it is necessary to have in the cylinder block an iron cylinder liner in which the piston of the engine reciprocates, due to the fact that aluminium is not a sufficiently wear resistant metal.

When assembling a mold for an aluminium engine block, the cylinder liners are generally positioned on a core known more specifically as a barrel core, which is integrally formed with the crankcase core. The cylinder liners are then preheated using induction heaters. The remainder of the mold is then assembled around the integral barrel and crankcase core, and the liners, and the mold is then filled, casting the iron liners into the engine block. The positional accuracy then of the bore liners relative to one another within a casting is determined in a large part by the dimensional accuracy and assembly clearances of the mold cores that support the bore liners during the filling of the mold.

The liners are preheated prior to casting in order to improve molten metal flow over the liners during casting; this in turn improves the quality and the mechanical and thermal properties of the completed casting.

A problem then with molds where the barrel core is integrally formed with the crankcase core is that the cylinder liners must be positioned on the barrels very early in the mold assembly sequence, as a result the liners can cool considerably between the time when they are preheated, and the time when the mold is filled with molten metal, due to the amount of mold assembly still required post heating.

Once cast, an engine block is typically put through a series of machining processes; one of these machining processes involves machining the internal diameter of the cylinder liners to ensure that the cylinder liners have uniform wall thickness, and a constant internal diameter along their length. This places further importance upon positional accuracy of the liners during casting.

Compounding this problem is that fact that, as a byproduct of its manufacture, a barrel core is formed with a draft, or external diametral taper, in order to permit removal of the core from the core box tooling once formed.

Consequently, when a conventional liner is disposed upon a barrel core, there is a mismatch, which increases along the length of the liner. Although the liner is located tightly at one end of the barrel core, at the distal end of the barrel core, the mismatch is it's most pronounced, permitting a degree of movement, which can potentially result in a misalignment of the liner in the casting.

It is an object of the present invention then to provide a cylinder liner, and mold assembly technique that overcomes or at least substantially ameliorates the problems associated with the cylinder liners and mold assembly techniques of the prior art.

Other objects and advantages of the present invention will become apparent from the following description, taken in connection with the accompanying drawings, wherein, by way of illustration and example, an embodiment of the present invention is disclosed.

DISCLOSURE OF THE INVENTION

In one form of this invention although this may not necessarily be the only or indeed the broadest form of this there is proposed an engine block mold, including at least one barrel slab core, the or each barrel slab core including a slab portion, and at least one barrel portion adapted to receive a cylinder liner, and at least one cylinder bore liner, wherein the barrel portion of the or each barrel slab core has an outer diametral taper along at least a portion of its length, and the or each liner has a substantially matching internal diametral taper along at least a portion of its length.

Preferably, the taper of the core and the cylinder liner, extends from the slab portion of the slab barrel core toward the distal ends of the barrel core.

Preferably, the taper of the cylinder liner, and the taper of the core, is applied along the entire length of each.

In a further form of the invention it can be said to lie in a method of assembling an engine block mold including the steps of:

preparing the cylinder liners, providing at least one barrel slab core, the or each barrel slab core including a slab portion, and at least one barrel portion adapted to receive a cylinder liner, the or each barrel having an outer diametral taper along at least a portion of its length; and disposing upon the or each core, via a first manipulation means, a cylinder liner that has a substantially matching internal diametral taper along at least a portion of its length;

using a second manipulation means to insert the or each slab barrel core and the or each liner disposed upon it, into a substantially completed mold casing.

Preferably, the step of preparing the cylinder liner includes cleaning and preheating the cylinder liners.

Preferably, the cleaning and heating of the cylinder liners is achieved using a fluidized sand bed.

Preferably, the manipulation means are robots.

Preferably, a further step includes casting molten metal in the mold to form an engine block.

Preferably, a further step includes machining the cylinder liners so that they have a substantially constant internal diameter along their length.

BRIEF DESCRIPTION OF THE DRAWINGS

For a better understanding of this invention it will now be described with respect to the preferred embodiment which shall be described herein with the assistance of drawings wherein.

BEST MODE FOR CARRYING OUT THE INVENTION

Figure 1:
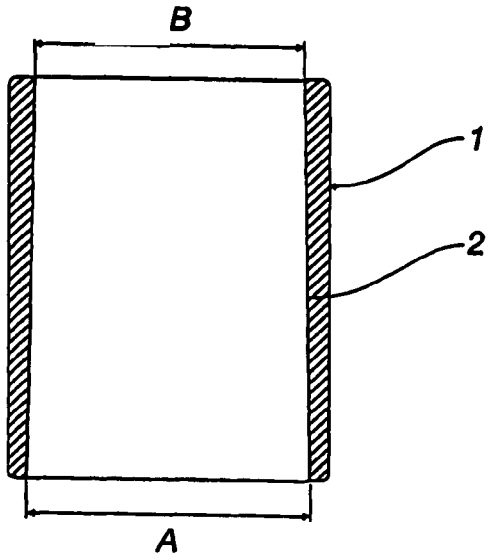
FIG. 1 is a cross-sectional view of the cylinder liner according to the preferred embodiment of the present invention.

Now referring to the illustrations, and in particular to FIG. 1, there is a iron cylinder liner 1, with an internal bore 2 that is tapered along its length, such that the diameter of the bore is greater at A than it is at B.

There is a slab barrel core 10 including a slab portion 12, and a barrel portion 14 adapted to receive the cylinder liner 1 via its internal bore 2. The barrel portion 14 is tapered along its length, such that the taper extends from the slab portion 12 of the slab barrel core 10 toward the distal end of the barrel core 14. The slab portion includes a shoulder 16, that the end of the cylinder liner will rest against when positioned correctly.

Figure 2:
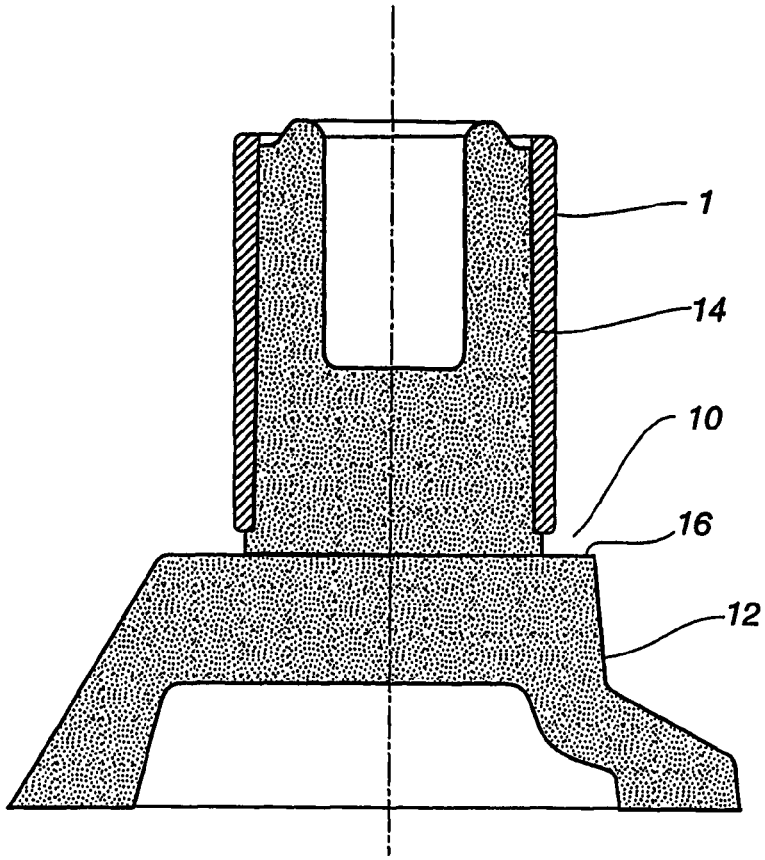
FIG. 2 is a cross sectional view of the cylinder liner in FIG. 1, showing it disposed upon a barrel core, prior to casting.

When the cylinder liner 1 is disposed upon the slab barrel core 10, as illustrated in FIG. 2, there is no mismatch, as the draft on the liner and the draft on the core are complimentary.

Due to the increased guidance provided by the complementary drafts on the barrel core 14 and cylinder liner 1, the task of disposing the cylinder liners upon the barrel cores lends itself to performance by programmable robots.

An advantage of this is that a robot can be used to take the cylinder liners directly from a fluidized sand bed in which the liners are simultaneously cleaned and preheated, and dispose them directly upon the barrel core 14. It is to be understood by those skilled in the relevant art however, that any of a number of alternate methods could be used to clean and/or preheat the cylinder liners, such as induction coils or infrared heaters in the case of preheating.

During preheat the iron cylinder liner will expand, increasing the diameter of the liner, making it easier to dispose the liner upon the barrel core. By carefully selecting the liner size, material and preheat temperature, when the liner retracts as it dissipates heat, it can be adapted to lock itself in position on the barrel core 14. Once the liner is locked onto the barrel core, the slab barrel core can be positioned in any desired orientation, including inverted, and the liner will not fall off of the barrel core.

The barrel core, complete with the liners, can then be positioned into a substantially completed mold assembly.

Some of the advantages associated with this process are that:

- A barrel slab core is smaller and therefore easier to manipulate than a composite crankshaft & barrel core.
- There is less waste (in terms of core volume and time) if a robot damages a barrel slab core while positioning liners on it, than if the robot damages a composite crank and barrel core. If a robot damages a barrel slab core, this barrel slab core can be rejected before final mold assembly. Of a robot damages a composite crankshaft and barrel core, the entire mold assembly process has to be stopped and the mold scrapped.
- The liners can be put on the slab core in a different location, remote to the mold assembly station, and then transported to the mold assembly station.
- It is much quicker to insert one or more barrel slab core(s) with all the cylinder liners already disposed upon it, than to position all of the liners onto a composite crank and barrel core, which in turn means there is less heat loss form the liners.
- The cylinder liners can be inserted into the mold later in the final mold assembly sequence, at a time closer to the metal pouring time, meaning less heat losses from the liners post liner preheat, therefore there is better metal flow over the liners during the pour.

A further significant advantage associated with a cylinder liner according to the present invention, is that in the subsequent casting operation the liner is tapered toward the fire face and mold risers, with the thickest part of the liner being at the crankcase end of the mold, which will in turn have the greater volumetric heat capacity. The volumetric heat capacity will be reduced as the liner tapers, setting up an optimized thermal gradient that promotes directional solidification towards the risers.

Figure 3:
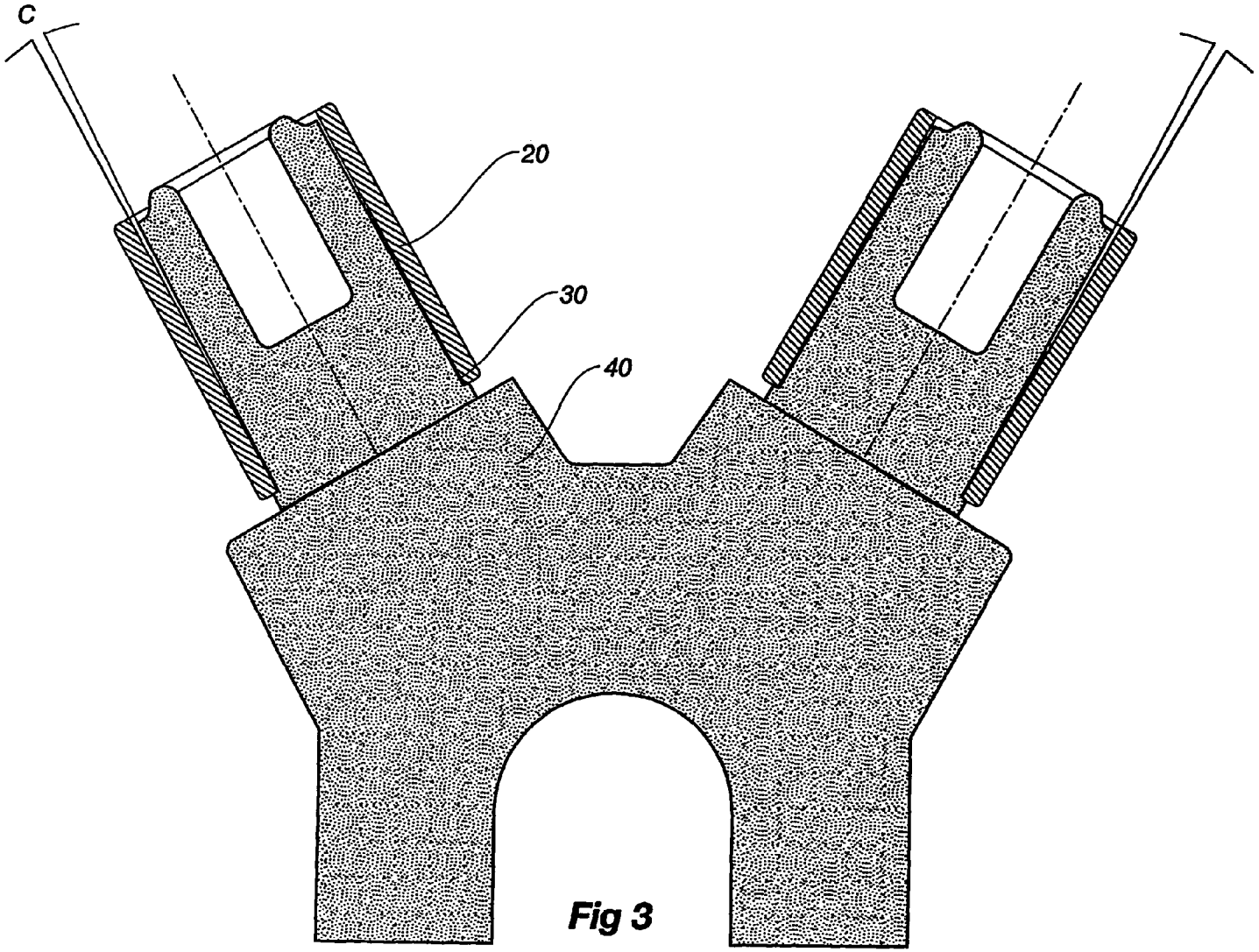
FIG. 3 is a cross sectional view of a conventional cylinder liner disposed upon a conventional composite crankshaft & barrel core prior to casting, illustrating the mismatch.

Referring now to FIG. 3, if a conventional cylinder liner 20, is disposed upon a barrel core 30 that is integral with the crankcase core 40, there is a mismatch C, between the internal diameter of the liner, and the outer diameter of the core. This mismatch introduces a potential for misalignment of the liner. Furthermore, it can be seen that a substantial amount of mold assembly is still required before the molten metal can be introduced to the mold, meaning the liner will loose a substantial amount of its preheat before casting.

Although the invention has been herein shown and described in what is conceived to be the most practical and preferred embodiment, it is recognized that departures can be made within the scope of the invention, which is not to be limited to the details described herein but is to be accorded the full scope of the appended claims so as to embrace any and all equivalent devices and apparatus.

The invention claimed is:

1. A method of assembling an engine block mold comprising a barrel slab core and a cylinder bore liner; wherein the barrel slab core includes a slab portion and a barrel portion extending from the slab portion, the barrel portion being adapted to receive the cylinder liner; wherein the barrel portion has an outer diameter taper along at least a portion of its length and the liner has a substantially matching internal diameter taper along at least a portion of its length; wherein:

said method comprises the steps disposing the cylinder liner on the barrel portion, and inserting the slab barrel core and the liner disposed thereon into a mold casing;

said method further comprises the step of preparing the cylinder liner;

said step of preparing the cylinder liner includes cleaning and preheating the cylinder liner; and said cleaning and heating of the cylinder liner is achieved simultaneously using a fluidized sand bed.

2. The method set forth in claim 1, wherein the taper of the cylinder liner and the taper of the barrel portion extends along substantially the entire length of each.

3. The method set forth in claim 1, wherein the barrel core is integral with a crankcase core.

4. A method as set forth in claim 1, wherein the disposing step and/or the inserting step is accomplished via manipulation means.

5. A method as set forth in claim 4, wherein the manipulation means are robots.

6. A method of casting an engine block comprising the steps of:

assembling an engine block mold according to the method of claim 1;

pouring molten metal into the mold to cast an engine block; and removing the cast engine block form the mold.

7. A method as set forth in claim 6, further comprising the steps of machining the cylinder liners so that they have a substantially constant internal diameter along their length.

8. A method of making an engine block mold comprising a plurality of the barrel slab cores and a corresponding plurality of the cylinder bore liners; wherein the barrel portion of each barrel slab core is adapted to receive the corresponding cylinder liner; wherein each barrel portion has an outer diameter taper along at least a portion of its length and each corresponding cylinder liner has a substantially matching internal diameter taper along at least a portion of its length; wherein:

said method comprises the steps disposing each of the plurality of cylinder liners on the corresponding barrel portion, and inserting the slab barrel cores and the liners disposed thereon into a mold casing;

said method further comprises the step of preparing the cylinder liners;

the step of preparing the cylinder liners includes cleaning and preheating the cylinder liners; and the cleaning and heating of the cylinder liners is achieved simultaneously using a fluidized sand bed.

9. A method as set forth in claim 8, wherein the taper of each barrel portion extends along substantially its entire length and wherein the taper of the corresponding cylinder liner extends substantially its entire length.

10. A method as set forth in claim 8, wherein the plurality of barrel cores are integral with a crankcase core.

11. A method as set forth in claim 8, wherein the disposing step and/or the inserting step is accomplished via robots.

12. A method of casting an engine block comprising the steps of:

assembling the engine block mold according to the method set forth in claim 8;

pouring molten metal into the mold to cast an engine block; and removing the cast engine block form the mold.

13. A method as set forth in claim 12, further comprising the steps of machining the cylinder liners so that they have a substantially constant internal diameter along their length.

* * * * *